US006565429B1

(12) United States Patent
Broberg

(10) Patent No.: US 6,565,429 B1
(45) Date of Patent: May 20, 2003

(54) SUPPLY AIR TERMINAL

(76) Inventor: Bo Broberg, P.O. Box 2075, S-196 02 Kungsangen (SE)

( * ) Notice: Subject to any disclaimer, the term of this patent is extended or adjusted under 35 U.S.C. 154(b) by 0 days.

(21) Appl. No.: 09/890,210

(22) PCT Filed: Jan. 26, 2000

(86) PCT No.: PCT/SE00/00153

§ 371 (c)(1),
(2), (4) Date: Jul. 27, 2001

(87) PCT Pub. No.: WO00/45096

PCT Pub. Date: Aug. 3, 2000

(30) Foreign Application Priority Data

Jan. 27, 1999 (SE) ..... 9900247

(51) Int. Cl.[7] ..... F24F 7/00
(52) U.S. Cl. ..... 454/306; 454/906
(58) Field of Search ..... 454/906, 306, 454/307, 243

(56) References Cited

U.S. PATENT DOCUMENTS

| | | | | |
|---|---|---|---|---|
| 1,523,268 A | | 1/1925 | McColl | |
| 2,423,241 A | * | 7/1947 | Kurth et al. | 454/306 |
| 2,522,860 A | * | 9/1950 | Conaway | 126/105 R |
| 3,815,486 A | * | 6/1974 | Morrison | 454/301 |
| 4,382,401 A | * | 5/1983 | Simmler | 138/115 |
| 6,261,174 B1 | * | 7/2001 | Kuehn | 454/290 |

FOREIGN PATENT DOCUMENTS

| | | |
|---|---|---|
| DE | 1 102 371 | 3/1961 |
| DE | 1 454 596 | 11/1968 |
| DE | 1 604 289 | 8/1970 |
| DE | 1 679 564 | 3/1972 |
| EP | 0 816 771 | 1/1998 |
| EP | 0 864 820 | 9/1998 |
| FR | 501 888 | 4/1920 |
| SE | 93844 | 12/1938 |
| SE | 442 669 | 1/1986 |
| SE | 506 143 | 11/1997 |
| WO | WO 98/01712 | 1/1998 |

* cited by examiner

*Primary Examiner*—Derek Boles
(74) *Attorney, Agent, or Firm*—Young & Thompson

(57) ABSTRACT

A supply air terminal designed for installation in an opening (3) in a wall (5) of a ventilation duct (7). The supply air terminal (1) extends in the duct (7) with a part (9) shaped to be able to take up part of the air flow transported in the duct and transport this for venting outside the ventilation duct (7), where the part (9) of the supply air terminal (1) has a considerable extend in the ventilation duct (7) in order to achieve a drop in pressure and a laminar flow in the supply air terminal (1).

6 Claims, 6 Drawing Sheets

SUPPLY AIR TERMINAL

Figure 1:
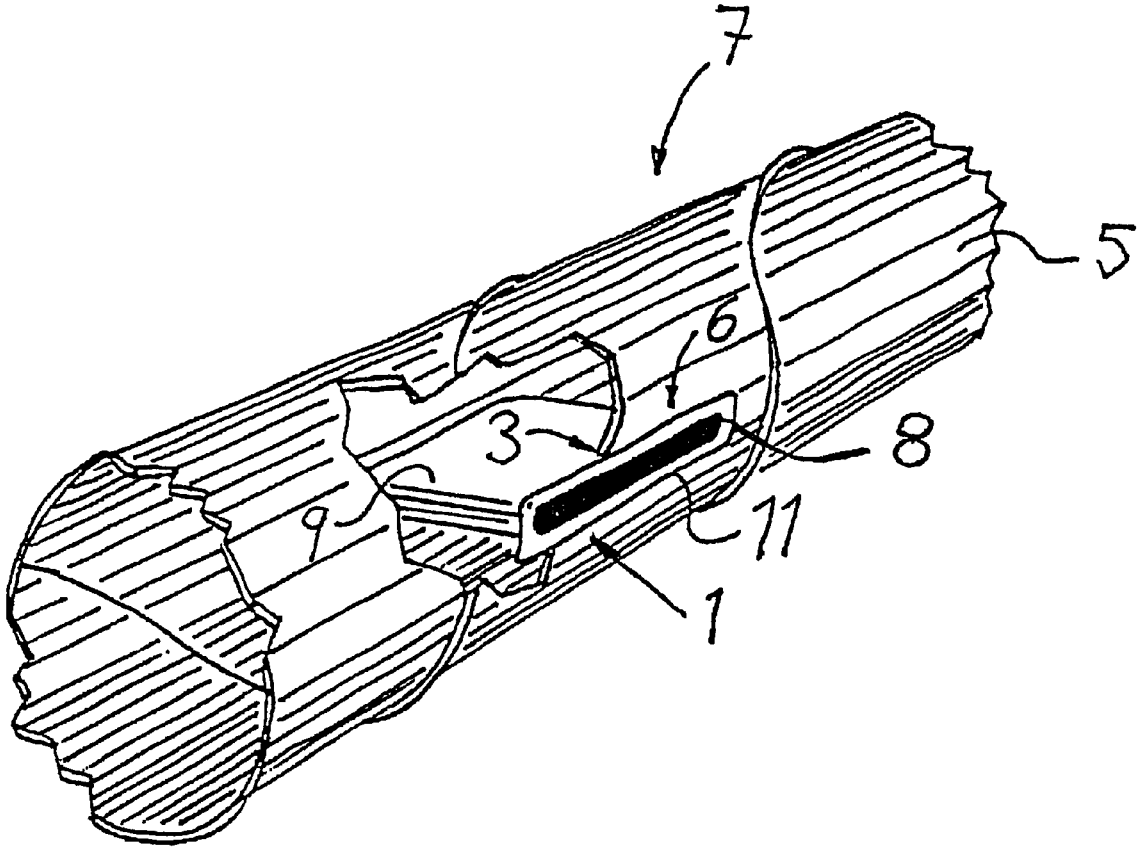

This invention concerns a supply air terminal designed for installation in an opening in a wall of a ventilation duct, which supply air terminal extends in the duct with a part shaped to be able to take up part of the air flow transported in the duct and transport this for venting outside the ventilation duct.

In order to achieve a supply of air inside buildings and rooms, storage premises and other large areas therein, it is usual to use supply air terminals, for example nozzles, grilles, air directing valves, etc., installed directly in, for example, rectangular or spiral flanged ducts. These ventilation ducts form a ventilation duct system comprising a main duct and a number of branch ducts through which an air distribution takes place. A fan is arranged at the start of this system in order to generate an air pressure.

Current technology suffers in general from the disadvantage that while the ducts in the ventilation duct system closest to the fan device are subject to a pressure many times greater than the system's ducts located further away from the fan device, the abovementioned nozzles or other grille arrangements for supply air must be placed in the branch ducts and not in the main duct. The known supply air terminals are installed together with a pressure reducing valve and sound dampers, which results in increased installation and operating costs and generally creates an unaesthetic interior design impression. Supply air grilles according to current technology create troublesome noise levels at relatively low drops in pressure.

It is desirable to eliminate pressure-reducing valves and sound dampers in the ventilation duct system by means of a supply air terminal which maintains a static overpressure and creates a laminar air flow, which supply air terminal is able to be installed directly in the main duct and/or branch ducts.

Current technology lacks flexibility in the installation of grille devices, as these must have different grille sizes and lamella designs.

Supply air devices according to current technology must in addition be provided with distribution valves or flap valves, which further complicate their use. Designs of such elements which are in use today contain a number of moving parts which can break. Similarly, the surface where a hole needs to be made for known ventilation devices has a relatively large extent over the surface of the casing of the duct which affects the durability of the ventilation ducts.

The grille and the valve according to current technology mean that the pressure must be reduced at the connection of the branch duct to the main duct. This is not desirable as grilles according to current technology cannot bridge pressure differences without creating noise.

Supply air devices according to current technology can also consist of a number of smaller nozzles which are placed individually in the wall of the ventilation duct. The number of nozzles is determined by the required air flow, which can result in a very large number of nozzles, with increased costs as a result This provides a certain drop in pressure but no laminar flow. Similarly, the installation of the abovementioned nozzles is complicated and expensive.

The aim of the invention is to eliminate the use of pressure-reducing valves and sound dampers in the ventilation duct system, by providing a supply air terminal which can be installed directly in the main duct and/or branch ducts.

A second aim is to provide a supply air terminal which in its internal part creates a laminar flow in order to be able to achieve long projections.

The aim is also to provide a supply air terminal which is cheap to manufacture and install. The supply air terminal must also provide a unobtrusive impression where interior design is concerned.

The invention further aims to provide a supply air terminal which can be mass-produced simply and cheaply in a few sizes. This supply air terminal must also allow good flexibility when being installed in a ventilation duct system, for example in a room in a building.

The above mentioned problems are solved by means of a supply air terminal of the type described in the introduction where part of the supply air terminal has a considerable extent in the ventilation duct in order to achieve a drop in pressure and also a laminar flow in the supply air terminal.

The extent inside the ventilation duct amounts to 60–90% of the internal diameter of the ventilation duct, which generally means that approximately 8% of the cross sectional area of the ventilation duct is taken up by the part of the terminal in the ventilation duct.

The terminal is provided with a slot-shaped duct, which extends in the longitudinal direction of the ventilation duct.

The cross section can for example, be drop-shaped or elliptical. The part of the terminal inside the duct can also be shaped so that a laminar air flow arises at the place where the air is forced into the terminal. This aerodynamic design can be achieved by means of current technology.

An internal duct in the terminal can also be designed so that it widens out towards the opening in the wall of the ventilation duct. That is to say that the cross section of the internal duct, viewed in the longitudinal direction of the ventilation duct, can have a trapezoid shape, which means that the air velocity is reduced so that the static pressure is maintained and the projection is reduced.

The invention means that a supply air terminal is produced which, with its simplified construction, creates a pressure reduction and a laminar flow in the supply air, which supply air terminal is simple and cheap to manufacture and allows flexibility when installing a ventilation duct system.

The invention also means that one or more terminals can be installed in the main duct without branch ducts and sound dampers needing to be used. This results in reduced manufacturing and installation costs.

In addition, the invention makes it possible to use the same size terminal throughout the whole ventilation system, where normally the ventilation ducts have a smaller diameter the further they are from the source generating the pressure. Reduction in pressure and laminar flow are achieved using the invention regardless of where in the system the terminal is situated. A number of terminals, for example installed in succession, can provide a larger air flow, dependent upon the air changes required.

The invention thus means that the supply air terminal only needs to be manufactured in a few sizes, that is to say a supply air terminal which can be installed simply using different types of inserts to give the supply air terminal the required characteristics, regardless of where it is situated in the ventilation duct system. The supply air terminal can be placed singly or in groups directly in the main duct. This means that a supply air terminal is achieved which can be mass-produced in a few sizes and can be provided with inserts as required. Where long projections are required, for example in large storerooms, the terminal can be installed in the ventilation duct horizontally with the ceiling of the room and not provided with any insert, as a laminar flow is obtained without such insert. If the supply air is required to have a turbulent flow, the terminal can be provided with inserts of various kinds. For example the insert can have a dispersion pattern where the supply air has a fan-shaped dispersion or as projected in a conical pattern.

Figure 2:
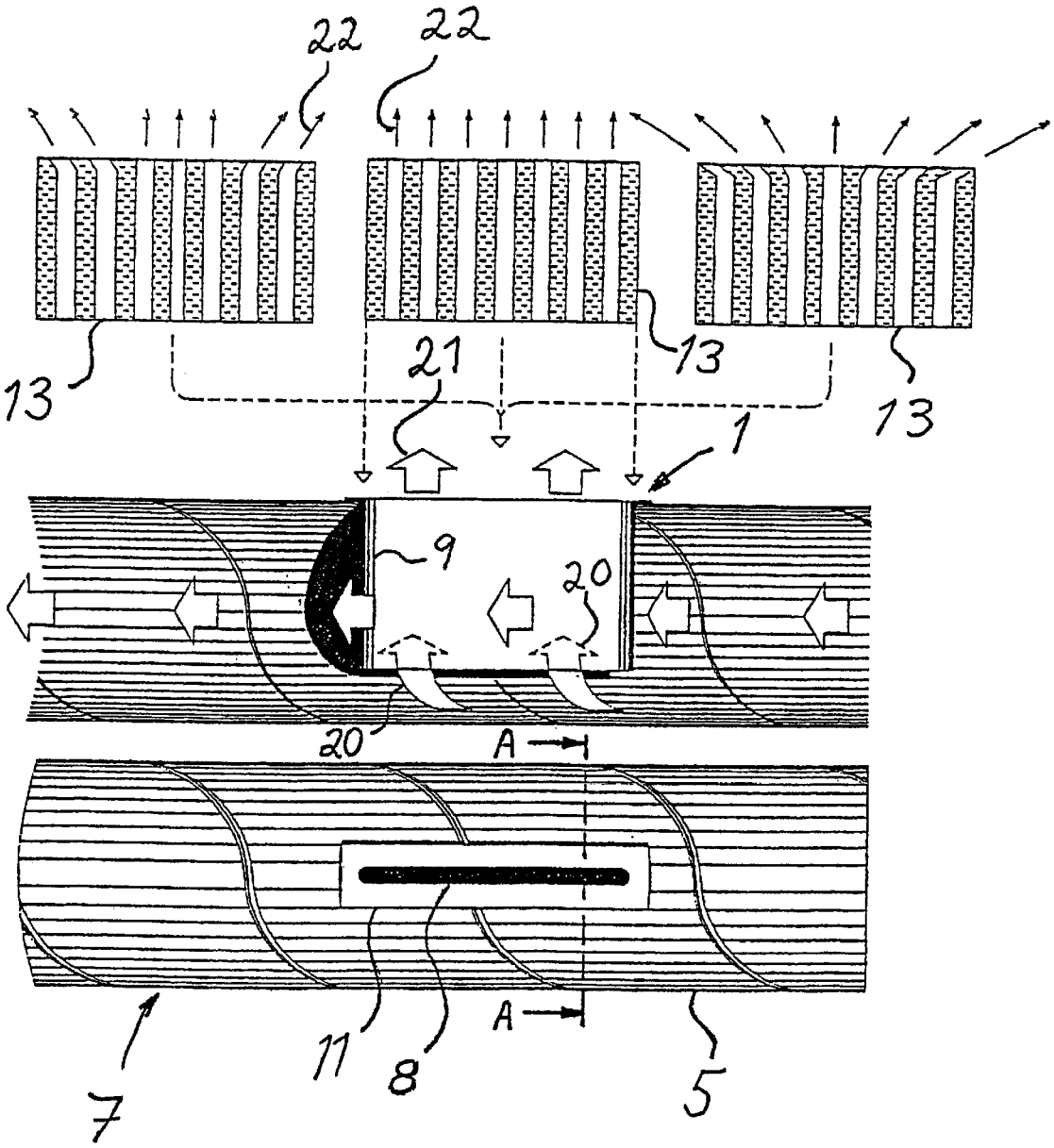
Figure 3:
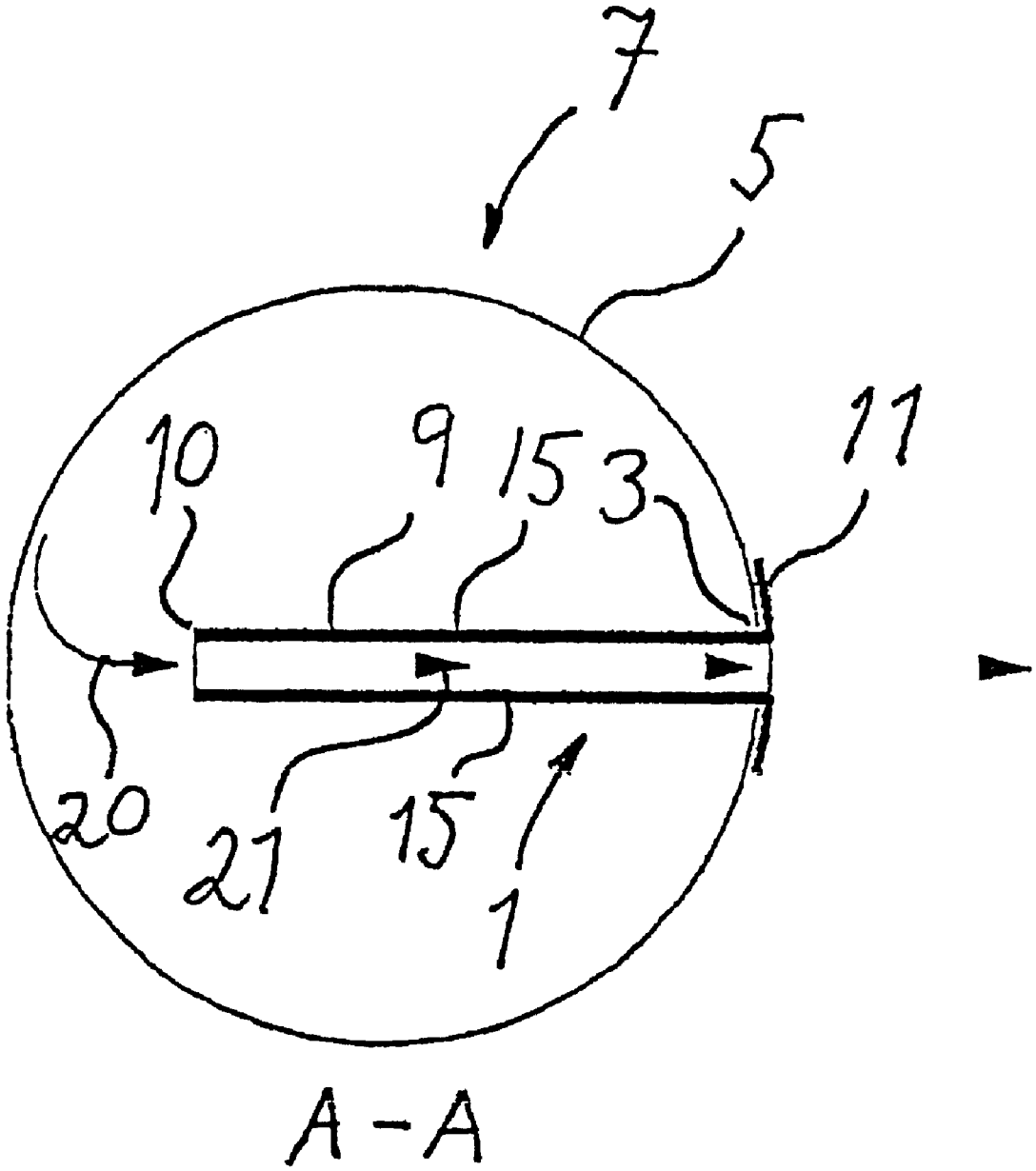
Figure 4:
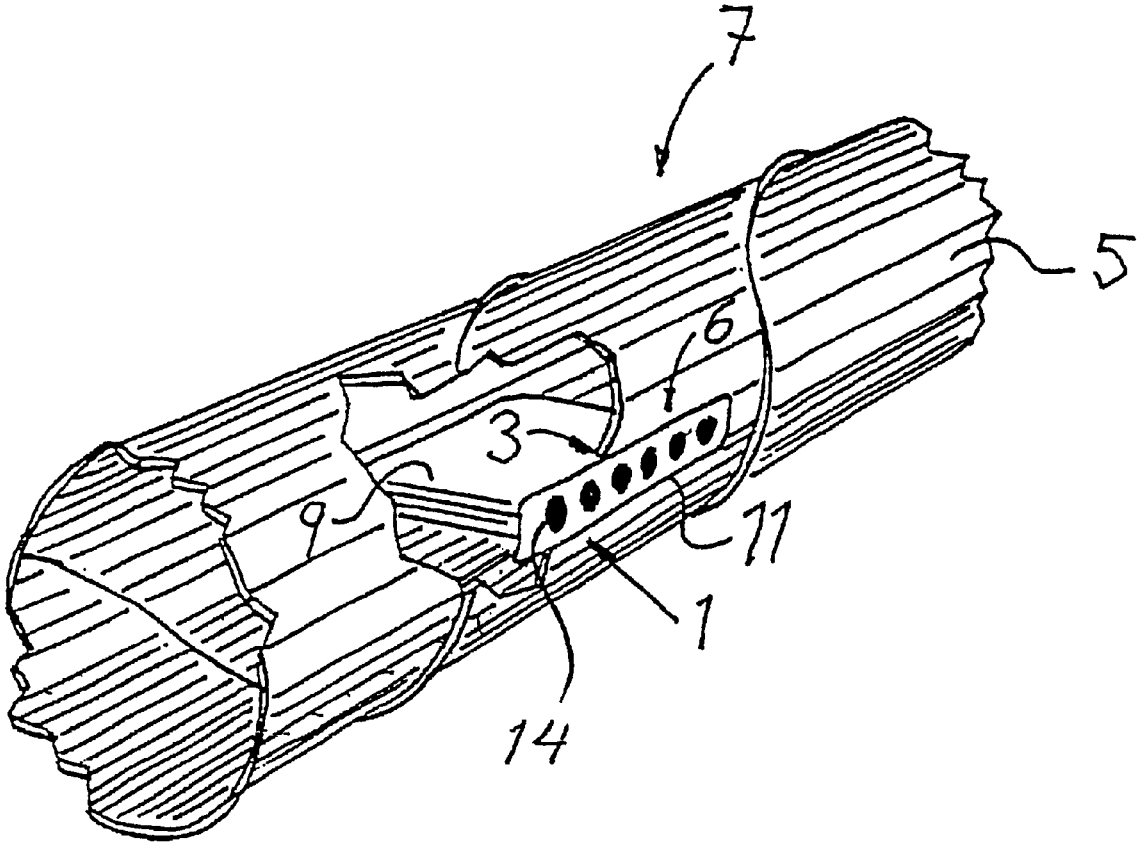
Figure 5A:
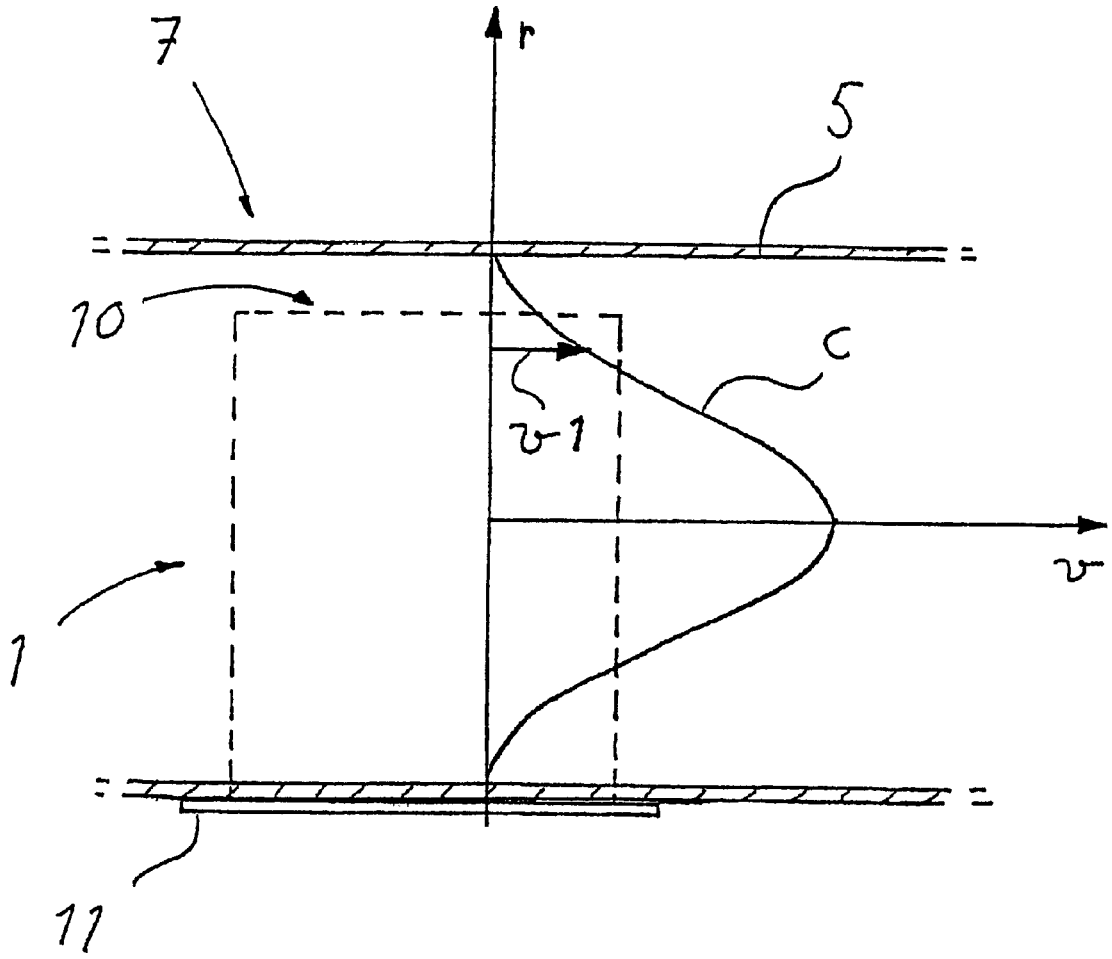
Figure 5B:
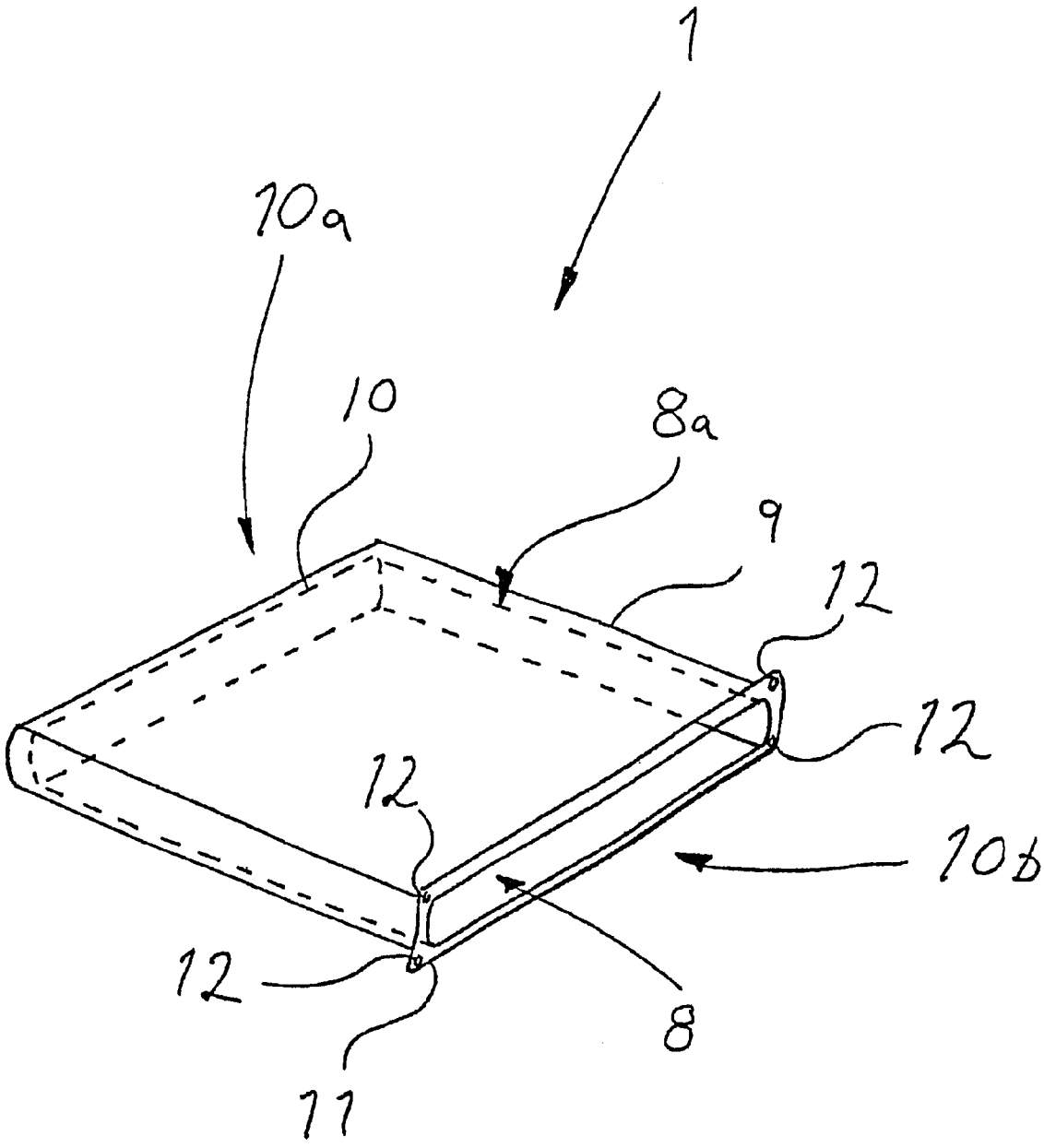

In the following, the invention will be described in greater detail utilizing examples of preferred embodiments and with reference to the attached figures, in which FIG. 1 shows a perspective view of a supply air terminal according to a first embodiment according to the invention, FIG. 2 shows two side views of a ventilation duct with supply air terminal according to the first embodiment, according to the invention, with three examples of inserts, FIG. 3 shows a cross section at the section A—A in FIG. 2, FIG. 4 shows a perspective view of a supply air terminal according to a second embodiment, FIG. 5*a* shows the velocity of the air flow in a ventilation duct, and FIG. 5*b* shows a supply air terminal according to the first embodiment of the invention.

FIG. 1 shows diagrammatically a ventilation duct 7, a so-called spiral duct in perspective. A supply air terminal 1 according to the invention is installed in an opening 3 in the wall 5 of the ventilation duct 7. The supply air terminal 1 extends inside the duct 7 by means of an inner part 9 with an extent which according to the embodiment is approximately 75% of the internal diameter of the ventilation duct 7.

A slot-shaped duct 8 is constructed in the supply air terminal 1 in the longitudinal direction of the ventilation duct 7. This duct 8 creates a laminar flow and a drop in pressure in the supply air.

The extent of the supply air terminal 1 in the ventilation duct 7 is slot-shaped in the embodiment according to the invention. The area of the part 9 can advantageously have a different shape in cross section, extending in the longitudinal direction of the ventilation duct 7. The cross section of the supply air terminal 1 can have a drop-shaped, elongated elliptical or other advantageously aerodynamic cross section, viewed across the ventilation duct 7 and in the longitudinal direction of the slot-shaped duct 8.

The embodiment further shows how an outer part 6 of the terminal 1 has a flange 11 which bears against the wall 5 of the ventilation duct 7. This can be attached to the wall 5 of the ventilation duct 7, for example by pop rivets (not shown).

FIG. 2 shows the first embodiment according to the invention using a side view of the spiral duct 7, in which the extent of the terminal 1 in the duct 7 is depicted and three inserts 13 for the terminal 1 are shown diagrammatically, and in which the unobtrusive design of the supply air terminal 1 according to the invention viewed from outside is shown.

Arrows 20 show how part of the air flow which moves in the ventilation duct 7 is taken up in the part 9 of the terminal. An arrow 21 illustrates a laminar flow out of the terminal 1. By means of the illustrated insert 13, shown as an example, to control or further suppress the air flow the supply air can move according to arrows 22.

The terminal 1 can advantageously be attached to the wall 5 of the ventilation duct 7 by means of a flange 11 on the outer part 6 of the terminal in contact with the wall. The terminal 1 can thus be designed to contain at least one insert 13, consisting of a sound-absorbent material, such as mineral wool, a combination of rubber and lead, etc. The insert 13, together with the relatively thick wall of the part 9 of the terminal inside the ventilation duct eliminates any vibrations arising in the terminal 1, which vibrations could generate noise.

The walls of the terminal can thus be made rigid and can advantageously be manufactured of sheet metal. Other materials which are non-combustible can also be used. Even plastic can be used. Tests have shown that a thickness of about 1–2 millimeteres for the walls of the terminal 1 is advantageous, but other thicknesses can also be used.

FIG. 3 shows a cross section A—A from FIG. 2. FIG. 3 shows diagrammatically how the air flow in the spiral duct 7, which air flow is illustrated by the reference 20, meets an air intake 10 in the part 9. In the embodiment this air intake 10 is slot-shaped in the longitudinal direction of the duct 7, but it can also have a different aerodynamic shape.

The arrow 21 illustrates a laminated air flow from the slot-shaped duct 8 of the terminal 1. The velocity can be 4–10 m/s. With a cross section of the part 9 in the longitudinal direction of the duct 7 where the slot-shaped duct 8, at an air velocity of 10 m/s, for example, is 1 cm×10 cm in size, the air flow will be 54 $m^3$/s from the supply air terminal 1. Where a larger air flow is required, several supply air terminals 1 can simply and unobtrusively be installed one after the other in the longitudinal direction of the ventilation duct 7. The laminar air flow is achieved inside the part 9 of the terminal 1.

According to the diagrammatically illustrated embodiment, the cross section of the part 9 in the longitudinal direction of the duct 7 has a slot-shaped design, but this design can of course be varied. For example, the part 9 can be gently curved or bent viewed in a cross section of the duct 7 and the terminal 1 at right angles to the longitudinal direction of the duct (not shown).

A curved part (not shown) would mean a longer transport distance for the air flow (not shown) which means that a laminar flow of the air flow can be achieved even in a ventilation duct 7 with a relatively small diameter and an air flow in the duct with a high velocity.

FIG. 4 shows a perspective view of a supply air terminal 1 according to a second embodiment. FIG. 4 shows diagrammatically in the same way as in FIG. 1 a ventilation duct 7, a so-called spiral duct, in perspective. The references in FIG. 4 indicate components with the same references as in FIG. 1. A supply air terminal 1 according to the invention is installed in an opening 3 in the wall 5 of the ventilation duct 7.

The air supply terminal 1 extends in the duct 7 by means of an inner part 9, with an extent similar to that in FIG. 1. In this second embodiment a number of parallel ducts 14 are arranged in a row inside the supply air terminal 1 instead of a slot-shaped duct 8 (FIG. 1). The openings in the ducts 14 are designed with air intakes (not shown) and air outlets (not shown) inside and outside the ventilation duct 7 respectively.

FIG. 5*a* shows a ventilation duct 7, a supply air terminal 1 (indicated by a broken line), a diagram and a graph c which illustrate the velocity distribution of the air flow in a ventilation duct 7. The horizontal axis shown in FIG. 5*a* shows the velocity v of the air flow at different distances from the centre line C of the ventilation duct. The vertical axis, indicated by r, shows how the velocity v is distributed along the radii of the ventilation duct 7. For example the velocity v is greatest at C, that is in the centre of the ventilation duct. The velocity v of the air flow is less closer to the wall 5 of the ventilation duct. The velocity v1 of the air flow is thus less than the velocity v2, as shown in FIG. 5*a*. Precisely at the wall 5 the velocity v is non-existent. Thus the velocity is lower at an outer area closer to the wall 5. This relationship is utilized by the invention. The supply air terminal 1 is arranged in the ventilation duct 7 so that, in its final position, its slot-shaped air intake 10 is within this outer area. Thus for ventilation ducts 7 with large radius, a supply air terminal according to the invention with sufficient extent in the ventilation duct 7 to achieve the overpressure described above can be placed so that the air intake 10 is within this area, even though the extent in the ventilation duct 7 does not pass the centre line C.

FIG. 5*b* shows diagrammatically in perspective a supply air terminal according to the first embodiment. The supply air terminal comprises a first opening 10*a* which is defined by a recess in the part 9 of the terminal, which opening forms the slot-shaped air intake 10. This air intake 10 is the start of a duct 8*a* which is designed as the slot-shaped duct 8 described above, which extends through the part 9 and ends in a second opening 10*b*. According to this embodiment, a flange 11 is arranged on the supply air terminal 1. This flange has four holes 12, through which holes 12 screws (not shown) are inserted for attaching the supply air terminal 1 to the wall 5 of the ventilation duct 7 (see FIG. 1).

Within the framework of the invention, the slot-shaped duct 8 can be designed in such a way that a turbulent flow is also brought about in the duct.

The supply air terminal 1 can of course be situated in other positions than traditional supply air terminals. The supply air terminal 1 according to the invention can be installed in an opening 3 in the ventilation duct 7 in various ways. The terminal according to the invention can be inclined, viewed in the longitudinal direction of the duct, as this terminal has a short extent in the longitudinal direction of the ventilation duct 7 compared to traditional terminals. It can also easily be positioned in such a way that the supply air goes out in a radial direction from the ventilation duct 7 horizontally, vertically or somewhere in between.

What is claimed is:

1. A ventilation duct comprising:

a wall defining a longitudinal duct through which air moves, said wall having an opening; and a supply air terminal in said opening, said supply air terminal having a slot therethrough that defines an air intake inside said duct and an air outlet outside said duct, said air intake being parallel to a longitudinal axis of said longitudinal duct, said supply air terminal having a lengthwise extension into said longitudinal duct that is 60–90% of an internal diameter of said longitudinal duct.

2. The ventilation duct of claim 1, wherein said supply air terminal has an air-flow-facing surface inside said longitudinal duct that has a length that is at least eight times a width thereof.

3. The ventilation duct of claim 1, wherein the lengthwise extension into said longitudinal duct is 75% of the internal diameter of said longitudinal duct.

4. The ventilation duct of claim 1, wherein said slot comprise plural separate openings that extend from said air inlet to said air outlet.

5. The ventilation duct of claim 1, wherein said supply air terminal has a width that is about 10% of the internal diameter of said longitudinal duct.

6. The ventilation duct of claim 1, wherein said supply air terminal has an air-flow-facing surface inside said longitudinal duct that has a surface area of about 8% of a cross sectional area of said longitudinal duct.

* * * * *